US005662517A

United States Patent [19]

Trojahn

[11] Patent Number: 5,662,517

[45] Date of Patent: Sep. 2, 1997

[54] COMPRESSED-AIR-DRIVEN METAL WORKING MACHINE

[75] Inventor: Hans-Werner Trojahn, Bergisch-Gladback, Germany

[73] Assignee: Joisten & Kettenbaum GmbH & Co. Joke KG, Bergisch-Gladbach, Germany

[21] Appl. No.: 357,120

[22] Filed: Dec. 15, 1994

[51] Int. Cl.[6] ..... B24B 5/00

[52] U.S. Cl. ..... 451/295; 451/363; 451/294

[58] Field of Search ..... 451/295, 294, 451/360, 363; 173/218, 219, 199, 198, 216, 74

[56] References Cited

U.S. PATENT DOCUMENTS

| | | | |
|---|---|---|---|
| 2,527,968 | 10/1950 | Sherman et al. | 451/456 |
| 3,129,642 | 4/1964 | Sorensen et al. | 173/219 |
| 3,827,834 | 8/1974 | Kakimoto | 451/295 |
| 3,921,731 | 11/1975 | Ekwall et al. | 173/199 |
| 4,083,152 | 4/1978 | Lorenz | 51/166 |
| 4,102,083 | 7/1978 | Stern | 451/295 |
| 4,103,460 | 8/1978 | Law | 451/295 |
| 4,302,910 | 12/1981 | Tschacher | 451/295 |
| 4,558,539 | 12/1985 | Hansson | 451/295 |
| 4,744,752 | 5/1988 | Nakayama et al. | 433/100 |
| 5,309,714 | 5/1994 | Putney et al. | 173/219 |

*Primary Examiner*—James G. Smith
*Assistant Examiner*—Dona C. Edwards
*Attorney, Agent, or Firm*—Standley & Gilcrest

[57] ABSTRACT

A metal working machine which has a tool support on which a rotatable working spindle is mounted which can be acted upon by oil-free compressed driving air. A separate duct provides oil-free compressed braking air which serves to stop the tool support after compressed air to the spindle has been switched off. Additionally, an oil-free mist is provided to the machine via a duct for lubricating the bearings of the tool support.

3 Claims, 2 Drawing Sheets

COMPRESSED-AIR-DRIVEN METAL WORKING MACHINE

BACKGROUND AND SUMMARY OF THE INVENTION

The invention relates to a metal working machine, more particularly a grinder, miller or the like, having a machine head in which a rotatable tool support is disposed.

Metal working machines of the kind specified are known in which the tool support is driven by compressed air and mainly comprises an all-lubricated working spindle having a turbine wheel disposed thereon. After acting upon the turbine wheel, the oil-containing driving air is conveyed to the ball bearings disposed in the zone of the driving spindle. The air still containing a residual oil then makes its way via a gap outwards in the direction of the workpiece to be processed.

The basic advantage of oil-containing driving air/lubrication is that it enables turbines to be operated at a relatively high speed above 100 000 rpm. However, on the other hand the oil-containing driving air/lubrication has the disadvantage that it cannot be used for the processing of hard metal or under laboratory conditions, because of the excessive lubricant emissions emerging from the metal working machine via the air flow.

In addition, in the prior art the quantity of lubricant supplied is coupled with the volumetric flow of compressed air, something which results in an excess of lubricant with an increasing performance of the metal working machine.

Moreover, however, in the prior art metal working machine not only the lubricant emissions but also the noise emissions are so high that they will in future also no longer be tolerable for reasons of labour protection.

German Utility Model G 92 11 971.9 suggests that the aforementioned disadvantages should be avoided by providing the corresponding metal working machine with a compressed air duct which is intended exclusively for oil-free driving air, the bearings of the tool support being lubricated via separate ducts filled with oil mist. Moreover, in the prior art metal working machine a sound absorber is provided in the compressed air duct, by means of which the noise emitted during the operation of the metal working machine has been appreciably reduced.

Practical trials of the metal working machine known from the aforementioned Utility Model have shown that operating personnel may be endangered by the tool support continuing to run, although the compressed driving air has already been switched off. Due to this prolonged after-running, a certain time must moreover elapse after the known metal working machine has been switched off before the previously used tool can be interchanged for a fresh tool.

It is an object of the invention so to further develop a metal working machine of the kind specified as to reduce the risk of injury and shorten tool-changing times.

This problem is solved according to the invention by a metal working machine, more particularly a grinder or miller, having a machine head in which a tool support is disposed which mainly comprises a rotatable working spindle having disposed thereon a turbine wheel which can be acted upon by oil-free compressed driving air flowing via a first compressed air duct to the turbine wheel; disposed on the flow-off side in the first compressed air duct is a sound absorber via which the compressed air emerges directly to the surroundings, a second compressed air duct being provided via which the turbine wheel can be acted upon by oil-free compressed braking air which exerts on the turbine wheel an impulse directed oppositely to the operative direction of the compressed driving air; and at least one further duct is provided which extends separately from the first and second ducts and through which an oil mist flows which lubricates the driving spindle of the tool support.

The metal working machine according to the invention has in comparison with the prior art metal working machines a further compressed air duct via which compressed braking air can be conducted to the turbine wheel after the compressed driving air has been switched off. This allows the reduction to a minimum of the time during which the tool support continues to run following the switching off of the compressed driving air. Similarly, the tool can be changed practically immediately after the shutting-off of the compressed driving air. This enables compressed-air-driven metal working machines of the kind specified to be used at automated processing centres at which the individual working steps succeed one another within very short processing cycles. At the same time the risk of injury due to the after-running of the tool support is substantially precluded in the case of corresponding manually operated metal working machines. The oil mist required for lubricating the bearing of the tool support can be produced in a simple manner by the feature that disposed on the inlet side of the duct through which the oil mist flows is an atomizer which produces the oil mist.

Moreover, in a preferred embodiment of the invention the tool support has a receiving opening for the working tool. At the same time, disposed in the zone of the receiving opening for the working tool is at least one vacuum line which removes the film of lubricating oil by suction in the zone of an annular gap.

The result of the vacuum suction removal is that the emergence of oil is also appreciably reduced, so that the metal working machine can be used even in areas in which very heavy demands are made on the purity, for example, of the surrounding air. To further minimize the emergence of the lubricant, in a particularly preferred embodiment of the invention the small quantity of air transporting the oil mist can also be recollected again after flowing through the ball bearings and be freed from any residual oil by a filter element prior to its emergence into the surrounding air.

The protection of the metal working machine according to the invention against wear can be further enhanced by the feature that inside the machine head in the zone of the outlet opening at which the driving spindle extends from the machine head, a chamber is formed which adjoins a shaft seal sealing the interior of the machine head off from the surroundings and which can be filled with barrier air forming a barrier against dirt entering the machine head in the zone of the shaft seal. With such a design of the metal working machine according to the invention the compressed air dammed in the chamber counteracts both during machine operation and stoppage very fine particles of dust which otherwise might penetrate through the shaft seals into the interior of the machine head.

The versatility of the metal working machine according to the invention can be enhanced by the feature that an adapter plate can be connected to the machine head via which the machine head can be connected to any required machine frame. Such multiple utilizability is important more particularly if such a metal working machine is to be used in conjunction with existing numerically controlled metal working centres.

It is also advantageous to the assembly of the metal working machine according to the invention if the compressed air ducts terminate jointly at an outside wall of the machine head, while attachable to said outer wall is a connecting member via which the supply lines for the compressed driving air and/or the compressed braking air and/or the oil mist can be connected to the machine head.

Finally, advantageously the turbine wheel constructed in the form of a disc and its peripheral surface is formed with pockets forming the working surface for the braking air. This is a simple way of reducing the number of the constructional elements required for driving and braking the tool support.

DETAILED DESCRIPTION OF THE DRAWINGS

Figure 1:
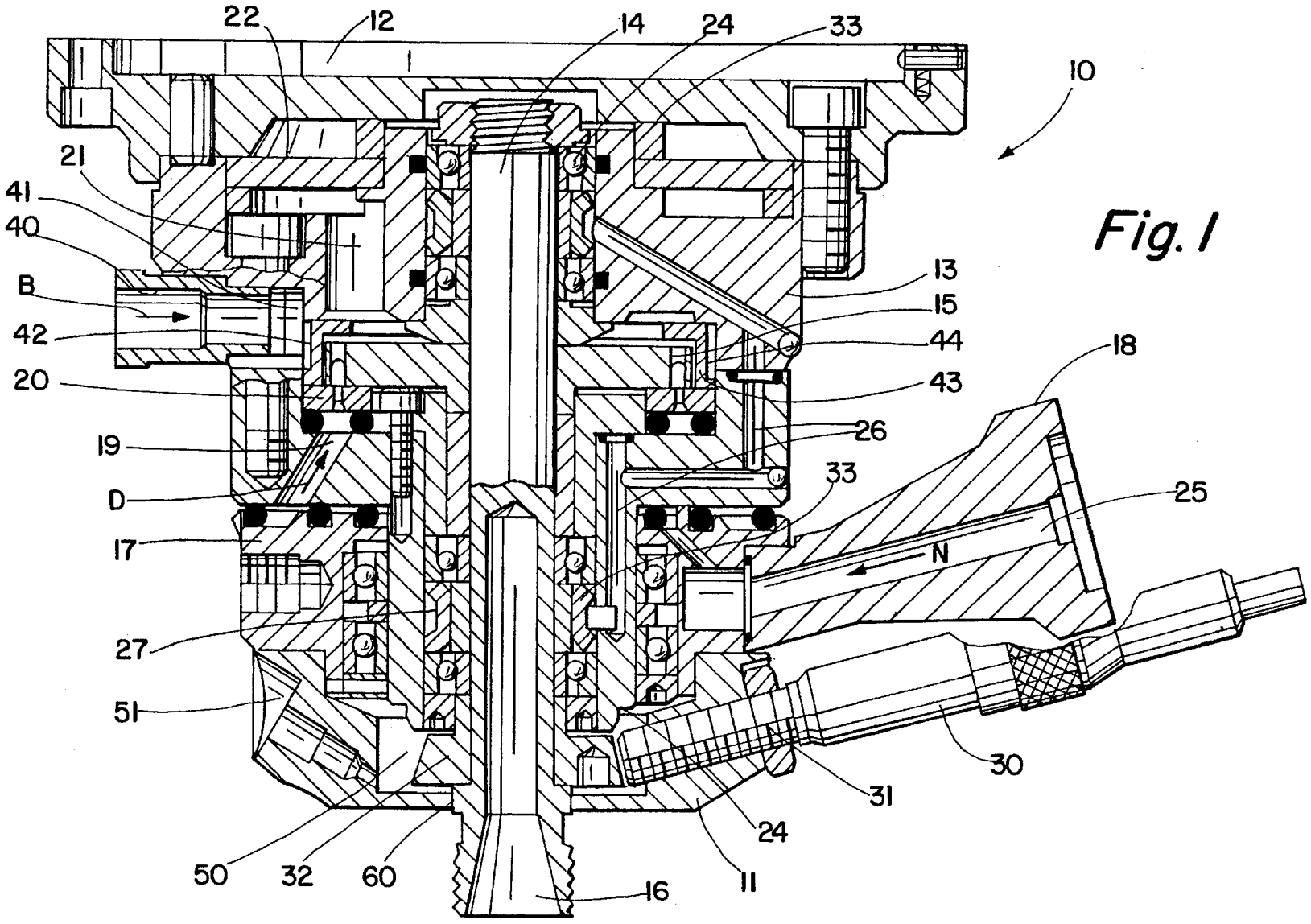
FIG. 1 is a sectional view of the metal working machine according to this invention.

The invention will now be explained in greater detail with reference to a drawing showing an embodiment thereof. The single Figure is a longitudinal section through the machine head of a metal working machine according to the invention.

A metal working machine has a machine head 10 bearing an adapter plate 12 on its top side. A receiving shaft (not shown), for example, can be connected to the adapter plate 12 and act as a means of attaching the machine head 10 to a machine frame. Disposed in the machine head 10 is a tool support 13 wherein a driving spindle 14 is rotatably mounted which is driven via a turbine wheel 15 connected thereto. The driving spindle 14 has at its free end a receiving opening 16 for a working tool (not shown). On the outside the tool support 13 is enclosed via a rotary member 17 which can move in relation to the tool support 13. Connected to the rotary member 17 is a connecting member 18 having a compressed air inlet (not shown) via which a flow of compressed driving air D is introduced into the metal working machine 10.

The compressed driving air D flows out of the compressed air inlet of the connection member 18 into a compressed air duct 19 and is then conducted in required manner by a deflecting disc 20 to the turbine wheel 15. The driving spindle 14 and therefore also the working tool attached thereto is driven by the energy of flow of the compressed air flow D.

After acting upon the turbine wheel 15, the compressed driving air flow D is conveyed via an intermediate duct 21 to a sound absorber 22. The annular sound absorber 22 can consist, for example, of a felt pad or foamed plastics and must on the one hand have a surface appropriate to the compressed air flow D and on the other hand a sufficiently high porosity, so that the counter pressure inside the machine head 10 does not become excessive. After passing through the sound absorber 22, the compressed driving air D flows into an outlet duct which discharges into the open air.

Disposed between the driving spindle 14 and the tool support 13 are ball bearings 24, which are lubricated by an oil mist. To this end the connection member 18 has a second inlet 25 into which a predefined quantity of oil is introduced, which is previously finely divided in a relatively small air flow. The resulting air/oil mixture, referred to hereinafter as an oil mist N, enters via the inlet 25 in channels 26 and is taken via the latter to spacing sleeves 27 disposed in each case between the ball bearings 24. The oil mist N is given off to the ball bearings 24 via fine bores 33 with which the spacing sleeves 27 are formed. Due to the small volume of air by which the lubricating oil is transported, the oil becomes deposited in the zone of the ball bearings 24 and finally forms a film of liquid. From that place the film of liquid moves by gravity to the receiving opening 16 for the working tool and is removed by suction via vacuum lines (not shown).

The small air flow by which the oil has been transported to the ball bearings 24 is finally collected in a duct (not shown) and conducted into the open air via a filter element which on the one hand acts as a sound absorber and on the other hand intercepts the residual oil content of the air.

Figure 2:
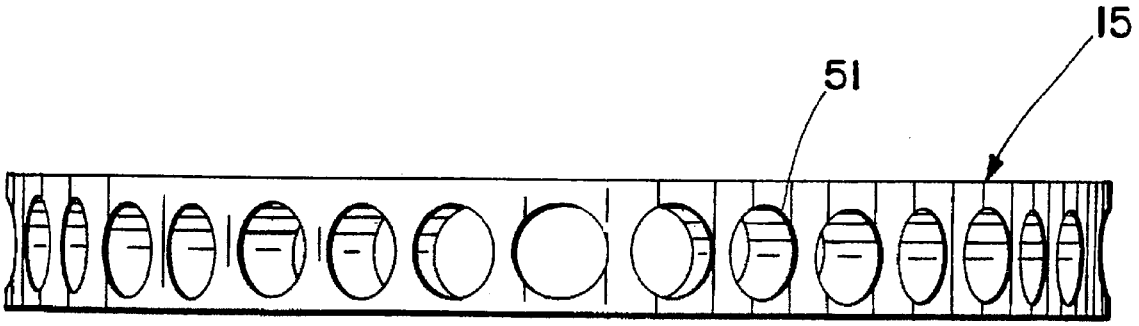
FIG. 2 is a side view of the turbine wheel.

As well as the inlet for the compressed driving air D and the inlet 25 for the oil mist N, the machine head 10 has an inlet 40 for oil-free braking air B. Via the inlet 40 the braking air B passes via ducts 41, arranged independently of the ducts 26 for the oil mist N and the ducts 19 for the compressed driving air D, into an annular space 42 which encloses the turbine wheel 15 in a circle and is separated therefrom by the wall of an insert ring 43. The wall of the insert ring 43 is formed with nozzle-like passage openings 44 via which the braking air B is conducted on to the side faces of the turbine wheel 15. The side faces of the turbine wheel 15 are formed with pockets 55 which form the surface of attack for the braking air B flowing on to the turbine wheel 15, as shown in FIG. 2.

Disposed on the casing 11 adjacent the receiving opening 16 is a tachometer 30 which has a sensing device 31. The sensing device 31 so cooperates with a projection 32 disposed on the driving spindle 14 that the tachometer 30 always has the actual speed available. The tachometer 30 is connected to a stored-programmable control system in which the actual speed measured by the tachometer 30 is continuously compared with the required speed inputted by the operator. If the speeds differ from one another, the pressure or volume of the working air is increased or reduced via the stored-programmable control system.

The projection 32 rotates in a chamber 50 which is formed in the lower zone of the machine head and can be filled with pressurized barrier air via a last inlet 51. The barrier air prevents dust from getting into the interior of the machine head 10 via the shaft seal 60 sealing the passage opening for the driving spindle during machine operation or stoppage.

What is claimed is:

1. A metal working machine having a machine head comprising:

a rotatable working spindle;

a turbine wheel operably connected to said rotatable working spindle, said turbine wheel being in the form of a disk and having a peripheral surface, said peripheral surface having pockets;

a first oil-free compressed air inlet and duct, oil-free compressed driving air from said first oil-free compressed inlet being directed toward said turbine wheel in an operating direction capable of turning said turbine wheel in said operating direction;

a second oil-free compressed air inlet, oil-free compressed braking air from said second oil-free compressed inlet being directed toward said pockets on said peripheral surface of said turbine wheel in a direction oppositely to said operating direction for braking said turbine wheel;

at least one oil-containing air inlet and duct, oil-containing air from said oil-containing air inlet for lubricating said rotatable working spindle; and a sound absorber disposed in said first oil-free compressed air duct downstream of said turbine wheel.

2. The metal working machine of claim 1 wherein the machine head has an interior, further comprising a shaft seal, located where said rotatable working spindle extends from said machine head, which seals the interior of said machine head from the surroundings and wherein a chamber is formed adjoining said shaft seal which can be filled with barrier air which forms a barrier against dirt entering said machine head at said shaft seal.

3. The metal working machine of claim 1 further comprising an adapter plate connected to said machine head whereby said machine head can be connected to a machine frame.

* * * * *